United States Patent [19]

Zornes et al.

[11] 4,265,391

[45] May 5, 1981

[54] NESTABLE BOX AND BOX BLANK

[75] Inventors: Larry Zornes, Cincinnati; Lloyd J. Farley, Batavia; Edward J. Powlenko, Cincinnati, all of Ohio

[73] Assignee: The Mead Corporation, Dayton, Ohio

[21] Appl. No.: 70,942

[22] Filed: Aug. 30, 1979

[51] Int. Cl.[3] ..... B65D 5/24

[52] U.S. Cl. ..... 229/34 R; 229/16 R; 229/36; 229/44 R; 229/DIG. 11

[58] Field of Search ..... 229/34 R, 34 HW, 33, 229/36, 44, 16 A, DIG. 11

[56] References Cited

U.S. PATENT DOCUMENTS

| | | | |
|---|---|---|---|
| 2,065,804 | 12/1936 | Guyer | 229/34 HW X |
| 2,163,117 | 6/1939 | Evans et al. | 229/34 HW |
| 2,271,265 | 1/1942 | Kirby | 229/34 R UX |
| 2,781,160 | 2/1957 | Bolding | 229/34 HW |
| 2,914,235 | 11/1959 | Jones | 229/34 R |
| 2,942,768 | 6/1960 | McCall | 229/16 A |
| 3,002,672 | 10/1961 | Kotowick | 229/34 HW X |
| 3,580,475 | 5/1971 | Mobley | 229/34 R |
| 3,820,706 | 6/1974 | Gibson et al. | 229/DIG. 11 X |
| 3,854,651 | 12/1974 | Osborne | 229/36 |
| 4,053,100 | 10/1977 | Baptist | 229/34 R |

*Primary Examiner*—Davis T. Moorhead

*Attorney, Agent, or Firm*—Biebel, French & Nauman

[57] ABSTRACT

A one-piece box blank which is formed of hingedly interconnected top, rear and bottom walls and end panels hingedly connected to the front and rear walls and adapted to interleave and interlock to form end walls of the box, has opposite ends of the bottom wall notched so that the bottom wall is shorter in length than the front and rear walls and is therefore adapted to nest in the top of a substantially identical box. Nesting is also facilitated by notches formed in the lower edges of the end walls and the fact that the upper edges of the end walls extend above the upper surface of the top wall. With this construction several containers can be stacked with the notched ends of the bottom wall received between the upper edges of the end walls, mechanically interlocking the boxes against end to end movement and providing substantial frictional resistance against side to side movement by virtue of the contacting surfaces of the stacked boxes.

5 Claims, 13 Drawing Figures

NESTABLE BOX AND BOX BLANK

BACKGROUND OF THE INVENTION

U.S. Pat. No. 2,942,768 of June 28, 1960. discloses a box formed from a one-piece blank which includes front, bottom, rear and top walls interconnected along their longitudinal edges and a tucker panel connected to the top wall along their common longitudinal edge. End panels are also provided which interleave and interlock to form the end walls of the box. While boxes of this general type can be produced with little waste material and provide a relatively sturdy construction, when such containers are stacked the stack may exhibit instability, particularly during warehouse or similar handling where it is desirable to be able to move and stack several boxes at a time.

SUMMARY OF THE INVENTION

The present invention provides a one-piece box blank and a box constructed from the blank which incorporates the desirable features of relatively little waste and sturdy construction of prior art one-piece box blanks, but also includes special provisions which permit several boxes constructed from the blanks to be stacked in nested relationship.

Specifically, the bottom wall of the blank is notched at opposite ends so that it is somewhat shorter than the front and rear walls of the blank. Additionally, the top wall is also shorter than the front and rear walls and is adapted to lay between the end walls of the box with the upper surface of the top wall beneath the upper edges of the end walls.

With this construction the boxes may be stacked with the bottom wall received between the end walls of an identical box, with the lower surface of the bottom wall resting on the top surface of the top wall and the upper edges of the end walls interlocked in the notches formed in the ends of the bottom wall and bearing against exposed portions of bottom panels overlying the bottom wall.

The interlocking of the upper edges of the end walls in the notches formed in the ends of the bottom walls prevents end to end movement of stacked boxes while the contact between the top surface of the upper edge panels of the end walls and the exposed bottom portions of the second end panels and the contacting surfaces of the top and bottom walls provides frictional resistance against displacement of the boxes in the front to back direction.

DESCRIPTION OF THE PREFERRED EMBODIMENT

Figure 1:
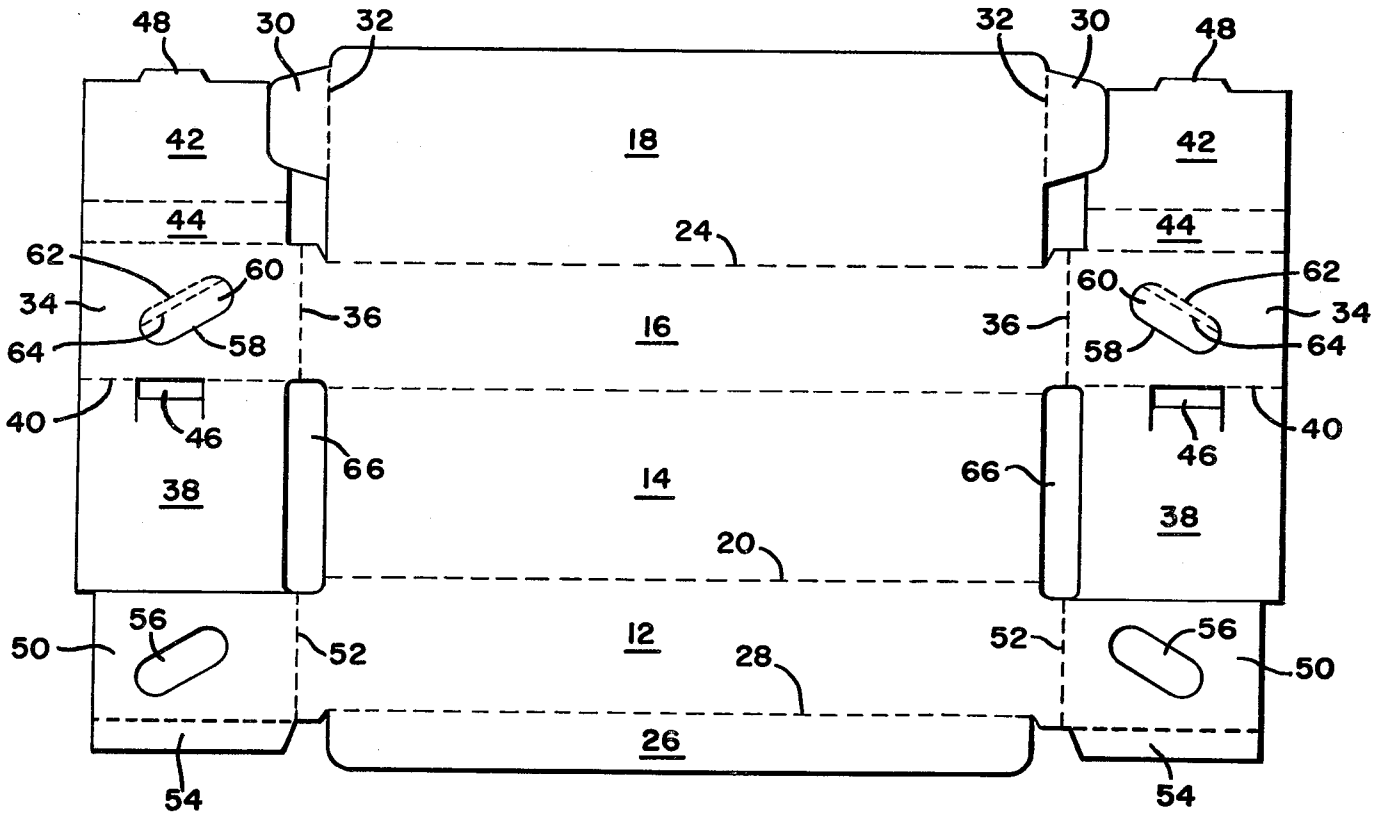
FIG. 1 is a plan view of a box blank in accordance with the present invention.

Referring initially to FIG. 1 of the drawings, it will be seen that a box blank 10 in accordance with the present invention may include a front wall 12, a bottom wall 14, a rear wall 16, and a top wall 18. The walls are hingedly connected along their longitudinal edges as indicated by dotted lines 20, 22 and 24. The front wall 12 may be provided with a front flap 26 hingedly connected to the front wall along the line indicated by the reference numeral 28, while the top wall may be provided with end flaps 30 hingedly connected to the top wall along the lines 32.

A first end panel 34 is hingedly connected as at 36 to opposite ends of the rear wall and second end panels 38 are hingedly connected to the first end panel along lines 40. Third end panels 42 are hingedly connected to the first end panels 34 by means of upper edge panels 44 along an edge of the first end panels 34 opposite the second end panels 38. It will be noted that the second end panels 38 include notches 46 which, as will presently be described, receive tabs 48 when the end panels are erected.

Fourth end panels 50 are hingedly connected, as at 52, to opposite ends of the front panel 12 and each of the end panels 50 carries a flap 54. Each of the end panels 50 also has formed therethrough a hand hold slot 56 which, when the carton is assembled, aligns with a complementary slot 58 formed in the first end panel 34. While material punched out of the end panels 50 to form the slots 56 is removed completely, material 60 punched from the end panels 34 to form the slots 58 is not removed completely, but it hingedly connected by the pairs of fold lines 62 and 64.

Notches 66 are formed in the box blank at opposite ends of the bottom wall 14 and extend into the front and rear panels 12 and 16 at their corners coincident with the corners of the bottom wall 14. This has the effect of shortening the length of the bottom wall 14 in comparison to the lengths of the front and rear walls 12 and 16 and also of shortening the height of the front and rear walls 12 and 16 as compared to the height in the assembled box of the first and fourth panels 34 and 50.

Figure 2:
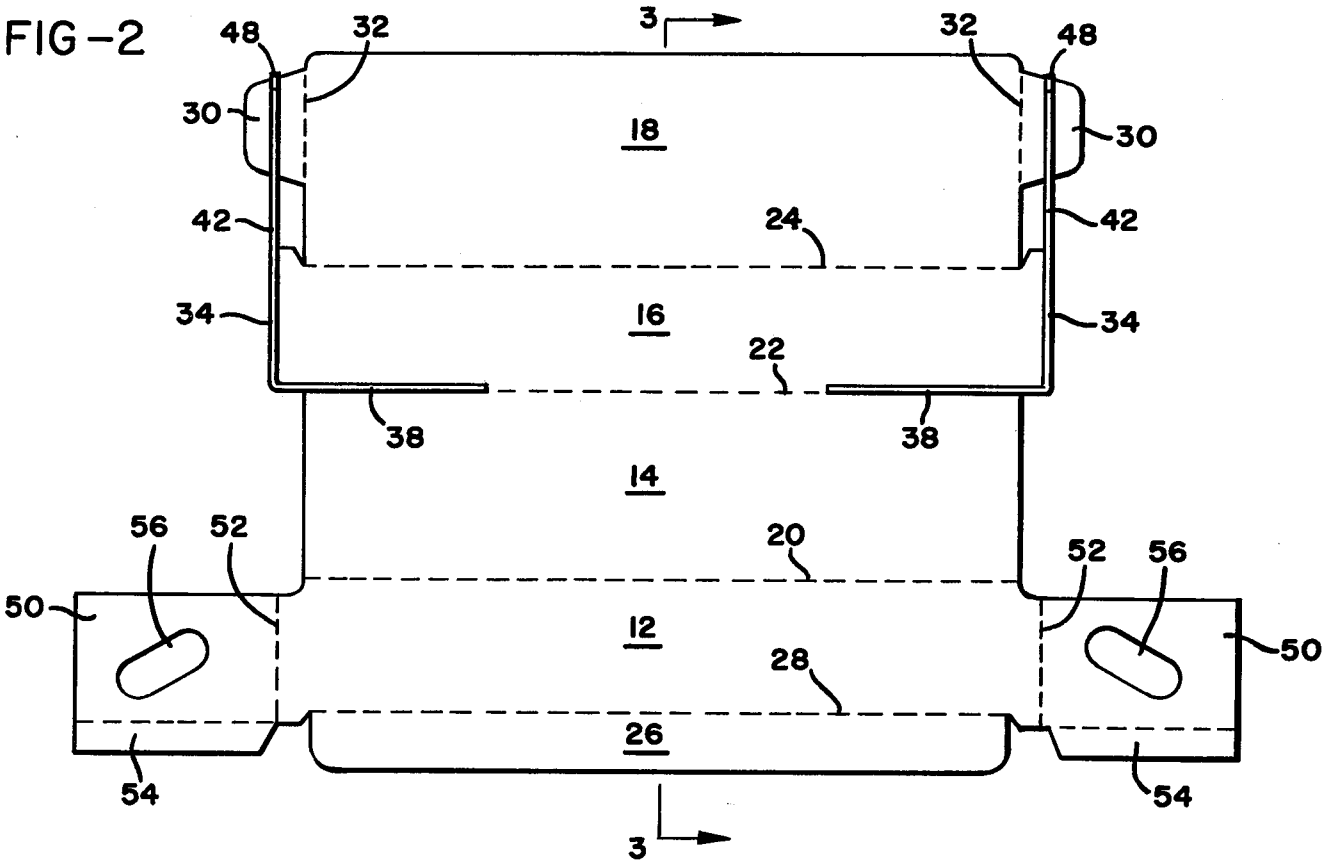
FIGS. 2 through 7 show succeeding steps in the erection of a box formed from the blank of FIG. 1.
Figure 3:
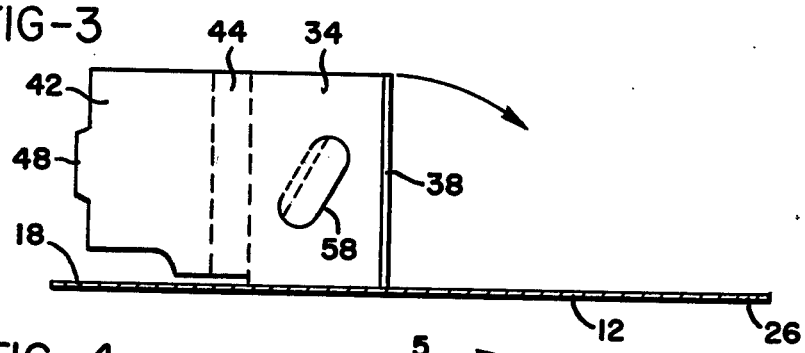

Turning next to FIGS. 1, 2 and 3 it will be seen that the first step in erecting the blank 10 into a box is to fold the second end panels 38 inwardly about the lines 40 and then fold end panels 34, 42 and 38 upwardly about line 36 to the position shown in FIGS. 2 and 3 of the drawings.

Figure 4:
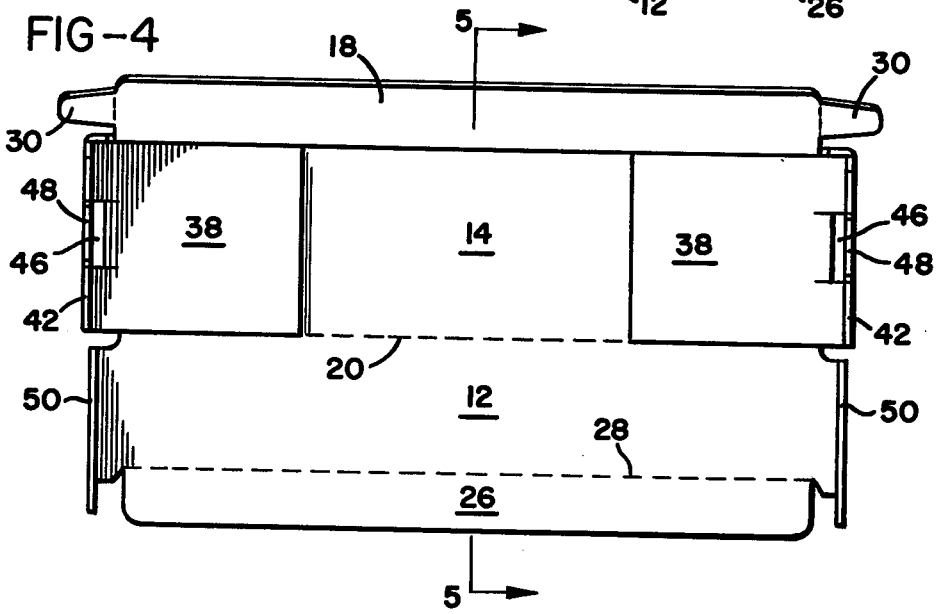
Figure 5:
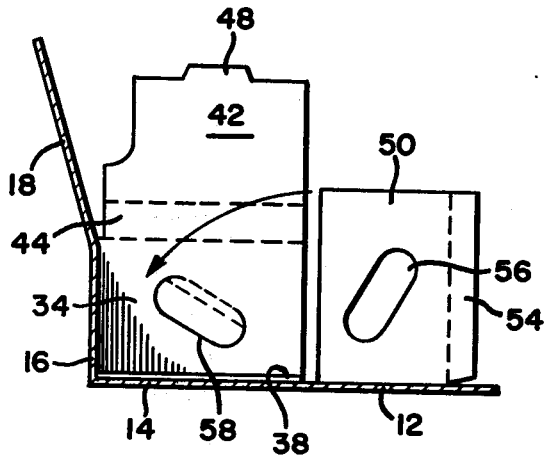

Next, as seen in FIGS. 4 and 5, the subassembly of walls 16 and 18 and attached panels 34, 38 and 42 are pivoted ninety degrees to the position shown in FIGS. 4 and 5. In this position end panels 38 overlie portions of the bottom wall 14 and end panels 34 and 42 extend vertically upwardly. End panels 50 are also folded about lines 52 from the position shown in FIGS. 1, 2 and 3 to that shown in FIGS. 4 and 5.

Figure 6:
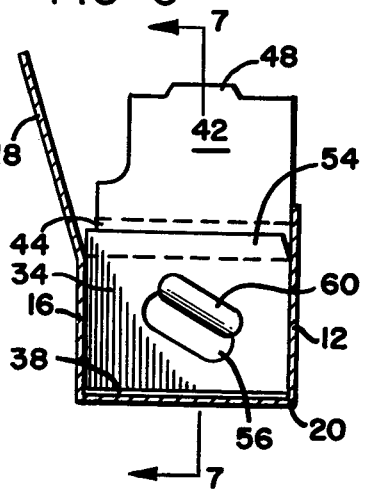
Figure 7:
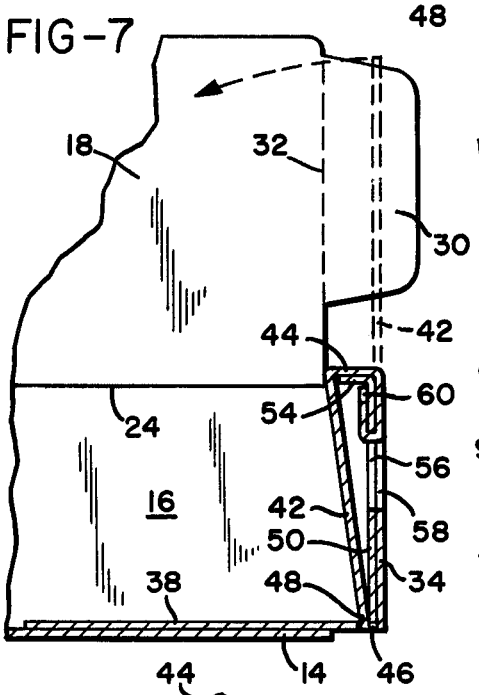

Following this, front wall 12 with attached end panels 50 and front flap 26 is folded ninety degrees about line 20 from the position shown in FIG. 5 of the drawings to that shown in FIG. 6. Referring to FIG. 7, end panel 42 is then folded from the dotted position shown in FIG. 7, which corresponds to the solid line position shown in FIG. 6, downwardly and inwardly to the solid line position with tab 48 received in slot 46 and panel 44 overlying flap 54, which has been folded inwardly to the position shown.

Figure 8:
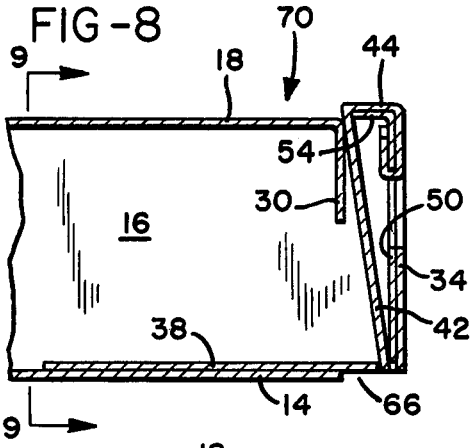
FIG. 8 is a cross-sectional view through a portion of an assembled box.
Figure 9:
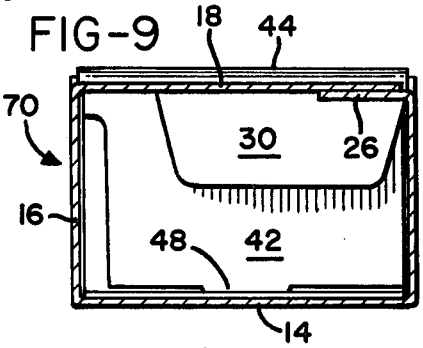
FIG. 9 is a view taken on line 9—9 of FIG. 8.
Figure 10:
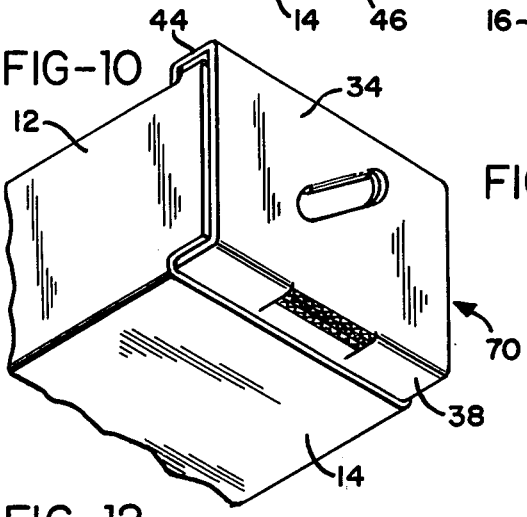
FIG. 10 is a perspective view of a portion of the box viewed from a lower end thereof.
Figure 11:
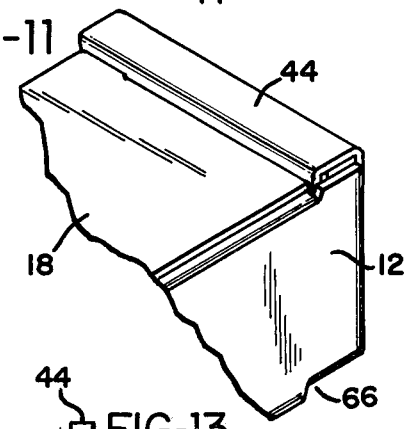
FIG. 11 is also a partial perspective view from the upper front of the box.

Portion 60 can then be folded inwardly about the lines 62 and 64 through the slot 56 to provide a hand hold defined by the aligned slots 56 and 58. Flaps 30 are then folded inwardly about lines 32 and top wall 18 is folded about line 24 to the position shown in FIG. 8 of the drawings to form an erected, closed box 70.

Panels 44 now form the upper edges of the end walls of the box, and as can be seen in FIGS. 8 through 13 of the drawings, the upper surface of the top wall 18 lies considerably below the upper edge 44 of the end walls. It will also be seen, particularly from FIGS. 8, 10 and 11, that the slot 66 has, in the erected box, the effect of shortening the bottom wall 14 longitudinally and the height of the front and rear walls 12 and 16.

Figure 12:
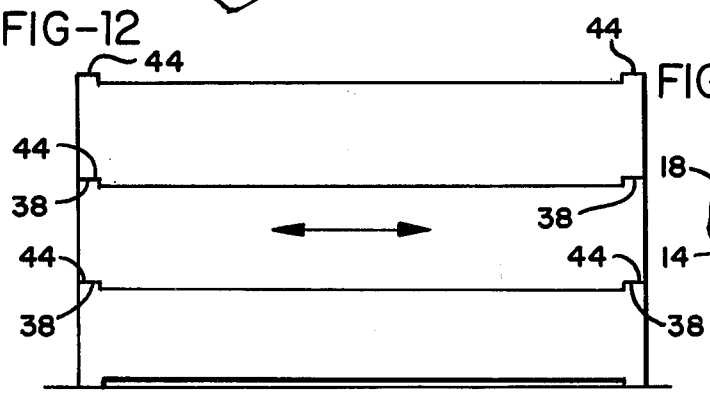
FIG. 12 is a diagrammatic view showing a stack of three boxes nested together.
Figure 13:
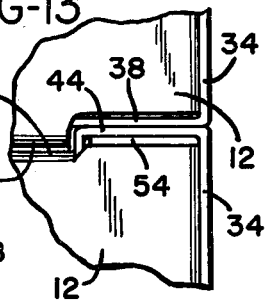
FIG. 13 is an enlarged view showing the nesting configuration of portions of a pair of boxes.

As a result, and as particularly seen in FIGS. 12 and 13, when the containers are stacked the upper edges 44 are received within the slots 66 in contact with the exposed portions of the end panels 38. This locks the boxes mechanically against end to end movement in the direction indicated by the double headed arrow in FIG. 12 of the drawings. Additionally, lateral stability in a direction perpendicular to the double headed arrow is also provided by the frictional contact between the panels 44 and 38 and the walls 14 and 18 of adjoining boxes.

Some elements shown in the preferred embodiment are obviously optional to one familiar in the art such as front flap 26, end panel flaps 54, tabs 48, notches 46, top wall end flaps 30, and the shape as well as the orientation of hand hold slots 56 together with complimentary slots 58.

It will also be apparent that although the top wall is shown as a single wall 18 hinged along one longitudinal edge 24 to the rear wall 16, the top wall could be formed as median flaps where two flaps are hinged to the front and rear walls and abut in the center of the box, or as partial overlap flaps where two flaps are hinged as in the median configuration and one overlaps the other for something less than the full distance between the front and rear walls, or as full overlap flaps where two flaps are provided hinged along their longitudinal edges to the upper longitudinal edges of the front and rear walls and fully overlap each other for the full distance between the front and rear walls.

From the above it will be seen that the present invention provides a one-piece box blank of economic construction and a box assembled from this blank which provides a positive mechanical interlock and increased stability between stacked boxes.

While the form of article herein described constitutes a preferred embodiment of the invention, it is to be understood that the invention is not limited to this precise form of article, and that changes may be made therein without departing from the scope of the invention.

What is claimed is:

1. In a box blank including rear, bottom and front walls hingedly interconnected and end panels connected to said walls and adapted to interleave to form end walls, the improvement comprising:

means defining notches at opposite ends of said bottom wall whereby said bottom wall is shorter in length than said front and rear walls, a top wall hingedly connected along a longitudinal edge thereof to a longitudinal edge of said rear wall, said end panels include first end panels hingedly connected to opposite ends of said rear wall and second end panels hingedly connected to said first end panels and adapted to overlie said bottom wall in a box constructed from said blank, means defining notches in said second panels adjacent their connections to said first panels, third ends panels hingedly connected to said first end panels opposite said second end panels, said third end panels carrying tabs adapted to engage said notches in said second end panels, and fourth end panels hingedly connected to opposite ends of said front walls, said front and rear walls are hingedly connected to opposite sides of said bottom wall and have notches formed therein at corners thereof conincident with corners of said bottom wall, and said second end panels have notches formed therein in edges thereof adjacent opposite ends of said bottom wall.

2. In a box formed from a one-piece blank including rear, bottom and front walls hingedly connected along adjacent longitudinal edges thereof, and end panels connected to said walls and adapted to interlock to form end walls, the improvement comprising:

means defining notches at opposite ends of said bottom wall whereby said bottom wall is shorter in length than said front and rear walls, and notches formed in lower edges of said end walls whereby said lower edges of said end walls are disposed above a bottom surface of said bottom wall and adapted to rest on raised upper edges of end walls of a substantially identical container.

3. In a box formed from a one-piece blank including rear, bottom and front walls hingedly connected along adjacent longitudinal edges thereof, and end panels connected to said walls and adapted to interlock to form end walls, the improvement comprising:

means defining notches at opposite ends of said bottom wall whereby said bottom wall is shorter in length than said front and rear walls, a top wall hingedly connected along one longitudinal edge thereof to said rear wall, and said top wall being shorter in length than said front and rear walls and adapted to lie with its upper surface disposed below upper edges of said end walls.

4. In a box formed from a one-piece blank including rear, bottom and front walls hingedly connected along adjacent longitudinal edges thereof, and end panels connected to said walls and adapted to interlock to form end walls, the improvement comprising:

means defining notches at opposite ends of said bottom wall whereby said bottom wall is shorter in length than said front and rear walls, a top wall hingedly connected along one longitudinal edge thereof to said rear wall, said top wall being shorter in length than said front and rear walls and adapted to lie with its upper surface disposed below upper edges of said end walls, said upper edges of said end walls also extending above upper edges of said front and rear walls and adapted to receive between them a bottom wall of a substantially identical container, and notches formed in lower edges of said end walls whereby said lower edges of said end walls are disposed above a bottom surface of said bottom wall and are adapted to rest on raised upper edges of end walls of a substantially identical container.

5. In a box formed from a one-piece blank including rear, bottom and front walls hingedly connected along adjacent longitudinal edges thereof, and end panels connected to said walls and adapted to interlock to form end walls, the improvement comprising:

means defining notches extending completely across opposite ends of said bottom wall, said bottom wall being shorter in length than said front and rear walls with opposite ends of said bottom wall being spaced inwardly of said end walls completely across said ends of said bottom wall, said end walls having upper edges extending vertically above upper edges of said front and rear walls, and said upper edges are adapted to receive between them a shortened bottom wall of a substantially identical container.

* * * * *